US010276274B2

(12) United States Patent
Haepers et al.

(10) Patent No.: US 10,276,274 B2
(45) Date of Patent: Apr. 30, 2019

(54) SEALING CONTAINER AND METHOD OF USE

(71) Applicant: Lantheus Medical Imaging, Inc., North Billerica, MA (US)

(72) Inventors: Joseph Haepers, Billerica, MA (US); Ralph Farella, Tuckahoe, NY (US)

(73) Assignee: Lantheus Medical Imaging, Inc., North Billerica, MA (US)

( * ) Notice: Subject to any disclaimer, the term of this patent is extended or adjusted under 35 U.S.C. 154(b) by 17 days.

(21) Appl. No.: 15/517,371

(22) PCT Filed: Oct. 2, 2015

(86) PCT No.: PCT/US2015/053724
§ 371 (c)(1),
(2) Date: Apr. 6, 2017

(87) PCT Pub. No.: WO2016/057328
PCT Pub. Date: Apr. 14, 2016

(65) Prior Publication Data

US 2018/0268951 A1 Sep. 20, 2018

Related U.S. Application Data

(60) Provisional application No. 62/060,291, filed on Oct. 6, 2014.

(51) Int. Cl.
*G21F 5/015* (2006.01)
*G21F 5/12* (2006.01)
*G21F 5/14* (2006.01)

(52) U.S. Cl.
CPC ..... *G21F 5/015* (2013.01); *G21F 5/12* (2013.01); *G21F 5/14* (2013.01)

(58) Field of Classification Search
USPC ..... 250/506.1, 507.1; 206/365; 600/3, 5
See application file for complete search history.

(56) References Cited

U.S. PATENT DOCUMENTS 5,519,931 A 5/1996 Reich
7,473,918 B2 1/2009 Yanke et al.
(Continued)

FOREIGN PATENT DOCUMENTS

EP 1 632 268 3/2006
GB 2 134 088 8/1984

OTHER PUBLICATIONS

International Search Report and Written Opinion dated Dec. 21, 2015 in connection with Application No. PCT/US2015/053724.
(Continued)

*Primary Examiner* — Kiet T Nguyen
(74) *Attorney, Agent, or Firm* — Wolf, Greenfield & Sacks, P.C.

(57) ABSTRACT

Containers for sealing and shielding radioactive fluid are disclosed. Methods of manufacturing such containers are also disclosed. The container is arranged to maintain a fluid tight seal to contain radioactive fluid when subjected to environmental forces, while also permitting a user to manually remove the cap from the container body when desired. In some embodiments, the container includes a container body with an inner chamber, along with an associated cap. The cap forms a fluid tight seal with the body by way of an interference fit between a sealing element and a burnished abutment surface.

23 Claims, 11 Drawing Sheets

(56) References Cited

U.S. PATENT DOCUMENTS

| | | | | |
|---|---|---|---|---|
| 2002/0130100 | A1 | 9/2002 | Smith | |
| 2008/0086025 | A1* | 4/2008 | Van Der Lee et al. | 600/3 |

OTHER PUBLICATIONS

Extended European Search Report for EP App. No. 15849209.0 dated Apr. 18, 2018.
International Preliminary Report on Patentability for PCT/US2015/053724 dated Apr. 20, 2017.

* cited by examiner

SEALING CONTAINER AND METHOD OF USE

RELATED APPLICATIONS

This application is a national stage filing under 35 U.S.C. § 371 of International Application No. PCT/US2015/053724, filed Oct. 2, 2015, which was published under PCT Article 21(2) in English, and which claims the benefit of U.S. Provisional Application No. 62/060,291 filed Oct. 6, 2014, and entitled "SEALING CONTAINER AND METHOD OF USE", the entire contents of which are incorporated by reference herein.

BACKGROUND

1. Field

Aspects herein relate to a container for sealing and shielding radioactive fluid. Methods of using and manufacturing the container are also described herein.

2. Discussion of Related Art

Radioactive fluids such as a radioactive gas can be packaged in vials that are placed within containers for transport. Existing containers are made of radiation shielding material, such as lead. Such existing arrangements rely upon the vials to seal and contain the radioactive gas, and thus the outer containers do not include a gas-tight seal for preventing leakage of radioactive gas. In some existing examples, the outer container includes a lid that is sealed to the container using tape. Such existing examples are not always able to prevent the escape of radioactive gases during a prolonged period of shipment.

SUMMARY OF INVENTION

According to one aspect, a container for a radioactive fluid is disclosed. The container includes a body having a hollow inner chamber for containing the radioactive fluid. The chamber includes an inner surface and an opening. A portion of the inner surface has a smooth burnished surface. The container also includes a cap that is removably couplable to the body for sealing the opening. The cap has a plug that is insertable into the chamber through the opening. The plug includes a groove, and an O-ring is disposed within the groove of the plug. An outer edge of the O-ring seats against the smooth burnished surface when the plug is fully received within the opening of the chamber. The body and the cap are made of a radiation shielding material.

According to another aspect, a method of manufacturing a container for a radioactive fluid is disclosed. The method includes forming a body having a hollow inner chamber for containing the radioactive fluid, where the chamber includes an inner surface and an opening. The method also includes burnishing at least a portion of the inner surface of the chamber to form a burnished portion of the inner surface and forming a cap that is removably coupleable to the body for sealing the opening, where the cap has a plug that is insertable into the chamber through the opening and the plug includes a groove. The method further includes coupling an O-ring to the cap by inserting the O-ring into the groove on the plug and inserting the plug into the opening of the chamber until the plug is fully received within the opening and the O-ring is seated against the burnished portion of the inner surface of the chamber to form a fluid tight seal. The body and the cap are made of a material substantially comprising a radiation shielding material.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. Various embodiments of the invention will now be described, by way of example, with reference to the accompanying drawings, in which.

DETAILED DESCRIPTION

Figure 1:
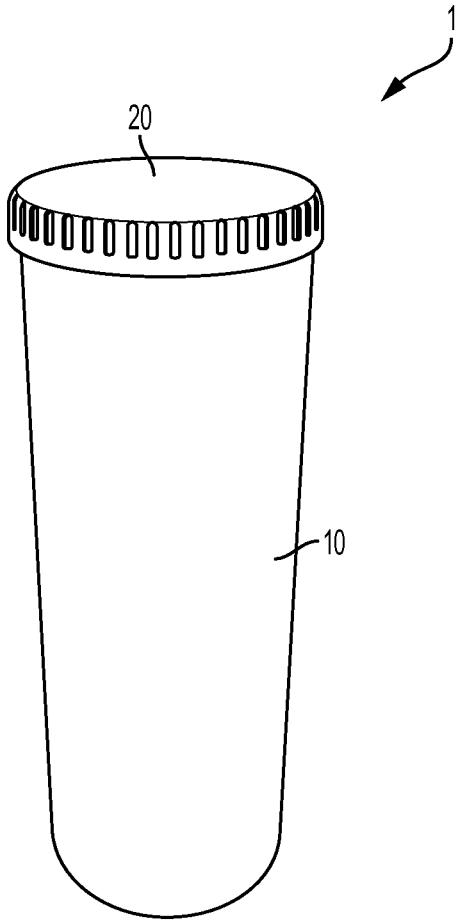
FIG. 1 is a front perspective view of a container in accordance with one aspect of the invention.

There exists a need to transport radioactive substances in leakproof containers that are able to achieve total or nearly-total containment of the substance. Packaging for radioactive materials may be subject to safety regulations established by government agencies such as the Department of Transportation (DOT) and associations such as the International Air Transport Association (IATA). Unintended leakage and release of substances such as radioactive drugs may pose a health risk, may give rise to loss of radioactivity from the dose that may render a study using the dose non-diagnostic, etc. One example of a transported radioactive substance is a radioactive fluid such as a radioactive gas or a radioactive liquid. One example of a radioactive gas is xenon Xe-133 gas. Other examples of radioactive gases include, but are not limited to: Xe-127, krypton Kr-81$^{m}$, iodine I-129 and I-131. Examples of radioactive liquids include, but are not limited to: gallium Ga-67, thallium Tl-201, indium I-111 and fluorine F-18.

There also is a need for a container that is able to maintain a fluid tight seal when the cap is subjected to various forces. For example, during shipment via aircraft, the container may be subjected to a pressure differential across the cap (i.e., the pressure inside the container being higher than the pressure outside the container), or physical trauma, such as vibrations or being dropped, which may tend to decouple the cap from the container body.

For ease of use, the container should permit a user to be able to manually remove the cap (by hand or using a hand tool such as a pair of pliers) from the container body. In most user environments, it is necessary to be able to remove the cap without resort to complicated machinery or tools.

According to one aspect of the invention, the container is arranged to form a fluid tight seal to contain a radioactive fluid, and is particularly configured to provide a gas-tight seal. In one embodiment, the container includes a body having a hollow inner chamber having a seal or the like for containing radioactive fluid. The container also includes an associated cap that is removably couplable to the body for sealing the opening. The cap forms a gas tight seal with the body by way of an interference fit between a sealing element and an abutment surface.

According to another aspect, the container is specially arranged to achieve a balance between resisting unwanted opening as a result of a pressure change, temperature change or physical trauma such as vibration or dropping while permitting manual opening by a user.

Many materials may be used to form the container. The most commonly used material is lead, because it is relatively inexpensive, is readily available and is very effective as a radiation shielding material. However, lead is soft and, especially when cast, has a relatively porous and uneven surface. Thus, it is very difficult to form a fluid-tight seal between a cap and the surface of a lead container. Accordingly, in another aspect of the invention, the sealing surface on the interior of the container is burnished using a tool to provide a smooth surface free of porosity and other irregularities.

Figure 2:
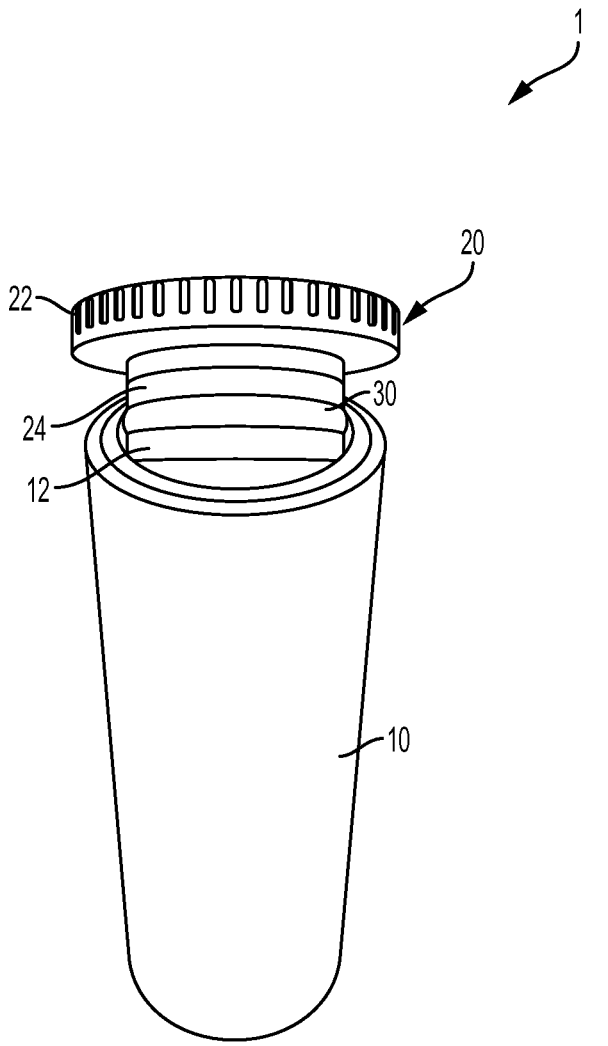
FIG. 2 is a front perspective view of the FIG. 1 container with the cap partially removed from the container body and tilted upward.
Figure 3:
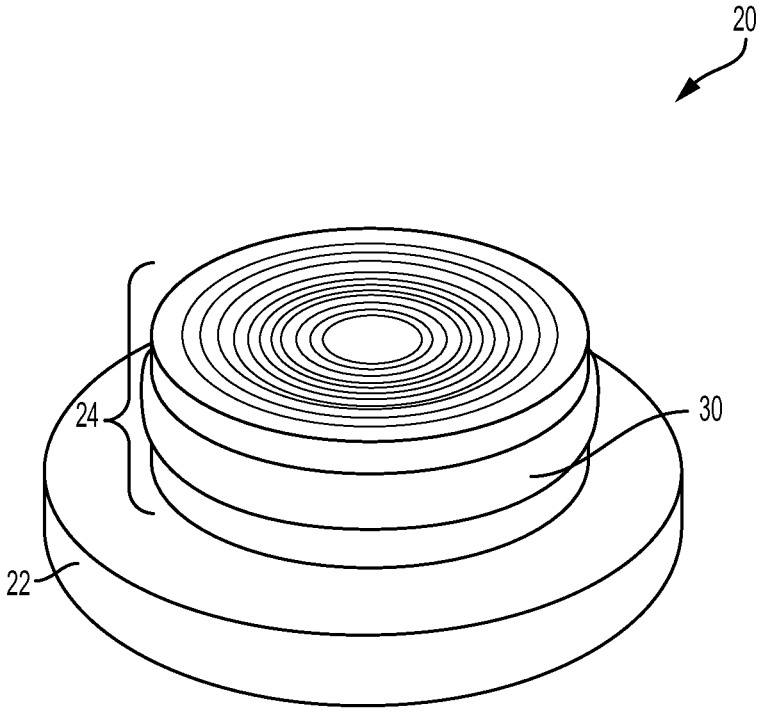
FIG. 3 is a bottom perspective view of the cap of the FIG. 1 container.

Turning now to the figures, FIGS. 1-8 depict one embodiment of the container. Container 1 includes a body 10 and a cap 20 that is removably couplable to the body 10. As seen in FIG. 2, where the cap 20 is shown being slightly lifted and tilted relative to the body 10 to partially reveal the opening 12 of the body 10, the cap includes a rim 22 and a plug 24. The plug 24 of the cap 20 is sized to be insertable into the body 10 through the opening 12, while the rim 22 is sized to remain outside the body 10. As can be seen in FIG. 2, the rim 22 may include a textured pattern on its edge to create a gripable surface and to facilitate removal of the cap from the body, as will be described in more detail below. As seen in FIG. 3, a sealing member 30 is coupled to the plug 24, as will be described in more detail below. The inner chamber 11 of the container body 10 is best seen in FIG. 6A. The inner chamber 11 includes an inner wall 14 and opening 12 through which plug 24 can be inserted. The inner wall 14 of chamber 11 may be slightly tapered from opening 12 downwardly toward the bottom of chamber 11 so that chamber 11 is wider at the top adjacent opening 12 than at its bottom. The chamber 11 may include a cushioning member 40 to cushion contents of the chamber such as one or more glass vials held within the chamber. One or more cushioning members may be included to cushion other portions of the chamber, such as the side walls or the bottom surface of the cap 20.

Typically, when shipping the container, the container is placed inside a shipping package with shock-absorbing foam inserts.

Figure 4:
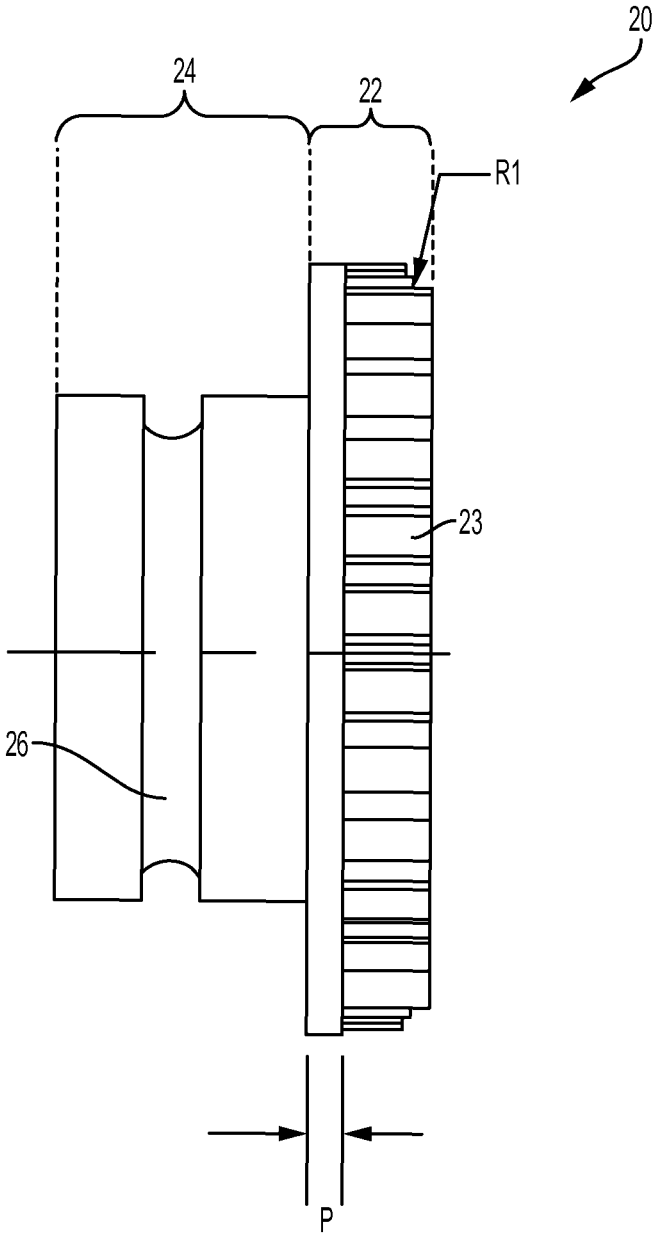
FIG. 4 is a side view of the cap of the FIG. 1 container.
Figure 5A:
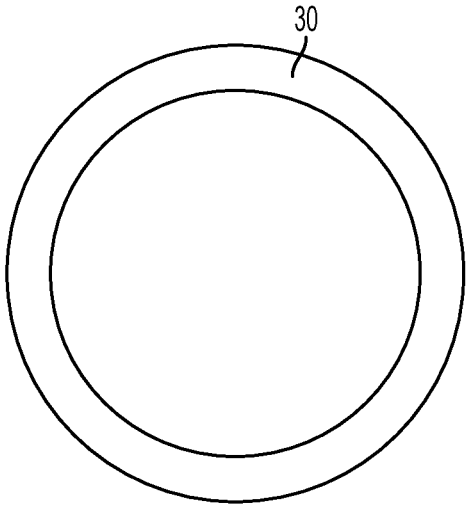
FIG. 5A is a top plan view of an O-ring sealing member used in the container.
Figure 5B:
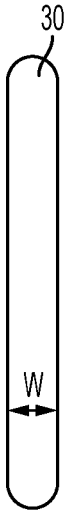
FIG. 5B is a side view of the FIG. 5A O-ring sealing member.

As mentioned above, according to one aspect, the container is arranged to form a fluid tight seal by way of an interference fit between a sealing element and a burnished abutment surface, and is particularly suited to form a gas tight seal. As seen in FIG. 4, the plug 24 of the cap 20 may include a circumferential groove 26. A sealing member such as an O-ring 30 is coupled to and wrapped about the plug 24 such as, for example, by fitting the O-ring 30 into the circumferential groove 26. In another embodiment, O-ring 30 may be disposed about the outer surface of plug 24 without being placed within a groove 26. In its natural, unstressed state, the inside diameter of the O-ring 30 is smaller than the diameter of the circumferential groove 26, and smaller than the outer diameter of plug 24. Thus, when the O-ring 30 is settled into the circumferential groove 26, or on plug 24, the O-ring 30 is slightly stretched and held in tension relative to its natural, unstressed state, which helps to retain the O-ring on the plug 24. An exemplary O-ring 30 is depicted in FIGS. 5A-5B. In one embodiment, at its resting, unstressed state, the O-ring 30 has an inside diameter of 0.5 inches, an outside diameter of 0.625 inches and a width W of 0.0625 inches. In one embodiment, the O-ring 30 is made of silicone rubber.

With the O-ring 30 coupled to the plug 24 of the cap 20, the cap can be coupled to the body of the container by inserting the plug 24 into the opening 12. In order to achieve an interference fit that helps to form a gas tight seal, the outside diameter of the O-ring when mounted to the plug must be larger than the inside diameter of the container body. In one embodiment, the outside diameter of the O-ring when mounted to the plug is 0.657 inches, while the inside diameter of the container body ranges from 0.640 to 0.645 inches. As such, the outside diameter of the O-ring 30 when mounted to the plug ranges from 0.012 to 0.017 inches greater than the inside diameter of the container body.

Figure 6B:
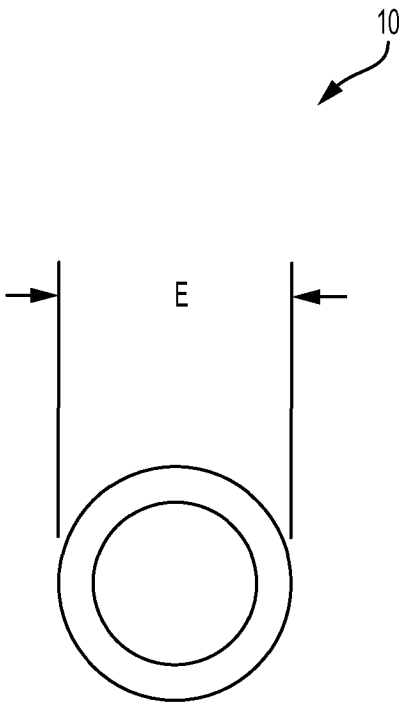
FIG. 6B is a top plan view of the body of the container.
Figure 6A:
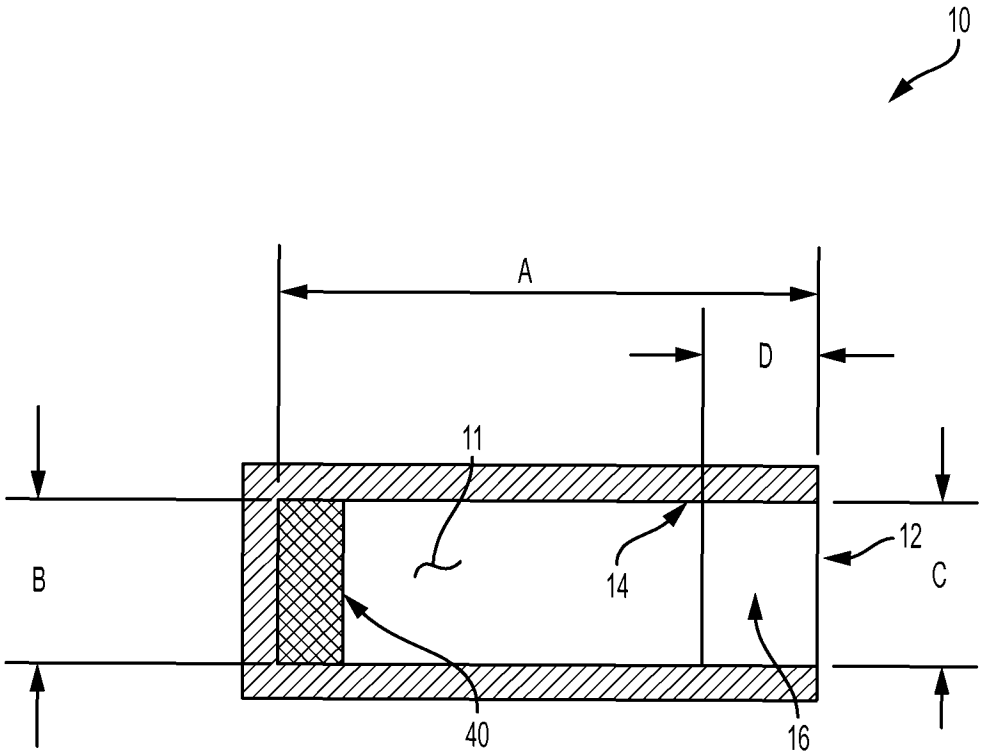
FIG. 6A is a cross-sectional side view of the body of the container.

To further aid in forming a seal, at least a portion 16 of the inner wall 14 may be burnished to provide a smooth surface against which the O-ring seals. The burnished surface is substantially free of porosity and other irregularities such that the O-ring 30 and the burnished surface of portion 16 form a gas tight seal. As best seen in FIG. 6A, portion 16 extends from the chamber opening 12 downwardly toward the bottom a distance D. In some embodiments, D may extend substantially the entire inner wall 14 of the chamber 11. In other embodiments, D may range from 0.6 to 1 inches or from 0.6 to 0.7 inches. In one embodiment, D is 0.641 inches with a tolerance of 0.01 inches. The method of creating such a burnished surface will be discussed below.

In some embodiments, the combination of O-ring 30 and portion 16 is capable of sealing container 1 when the pressure inside the chamber 11 is higher than the pressure outside by 7 to 13.8 psi, by 7 to 15 psi, by 4 to 15 psi or by less than or equal to 13.8 psi. In some embodiments, the combination of O-ring 30 and portion 16 is capable of sealing container 1 and preserving the containment of radioactive materials when subject to temperatures in the range of −40° C. to 70° C. In some embodiments, the combination of O-ring 30 and portion 16 is capable of sealing container 1 and preserving the containment of radioactive material when subject to physical trauma such as vibration. With the container 1 held inside a shipping package with shock-absorbing foam inserts, the combination of the O-ring 30 and portion 16 is capable of preserving the containment of radioactive material within the container 1 when the shipping package is subject to a drop of up to 9 meters.

Specific dimensions of a container body and cap according to one aspect of the invention are labeled in FIGS. 6-7 and will now be discussed. In some embodiments, the container body and cap are made predominantly of a cast lead. As a relatively soft material, lead can be challenging to form into precise shapes. As such, it should be appreciated that the relative dimensions of the container components may be critical to forming a fluid tight seal, and is particularly suited for forming a gas tight seal. As seen in FIG. 6A, the container body 10 has a hollow inner chamber 11 with a depth A and an inside diameter B. In some embodiments, depth A may range from 7 to 10 inches or 1 to 3 inches. In one embodiment, depth A is 8.82 inches. In another embodiment, depth A is 2.238 inches with a tolerance of 0.015 inches. In some embodiments, inside diameter B may range from 0.6 to 0.7 inches. In one embodiment, diameter B is 0.631 inches. Opening 12 has a diameter C. In some embodiments, diameter C may range from 0.6 to 0.7 inches. In one embodiment, diameter C is 0.641 inches with a tolerance of 0.01 inches. The diameter C may be slightly larger than the inside diameter B of the rest of the inner chamber. Also, chamber 11 may be tapered, such that the inside diameter of the inner chamber 11 may increase in a direction from the bottom toward the chamber opening 12 along at least a portion of chamber 11. As seen in FIG. 6B, the container body 10 has an outside diameter E. In some embodiments, outside diameter E may range from 0.8 to 1.1 inches. In one embodiment, outside diameter E is 0.915 inches with a tolerance of 0.015 inches.

Figure 7A:
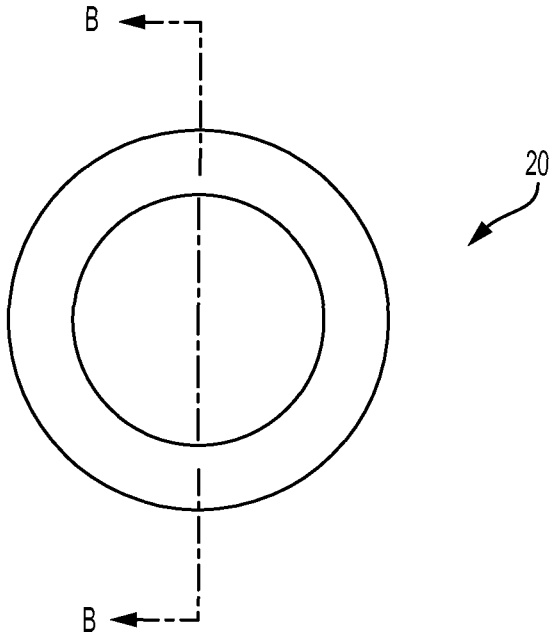
FIG. 7A is a bottom plan view of the container cap.
Figure 7B:
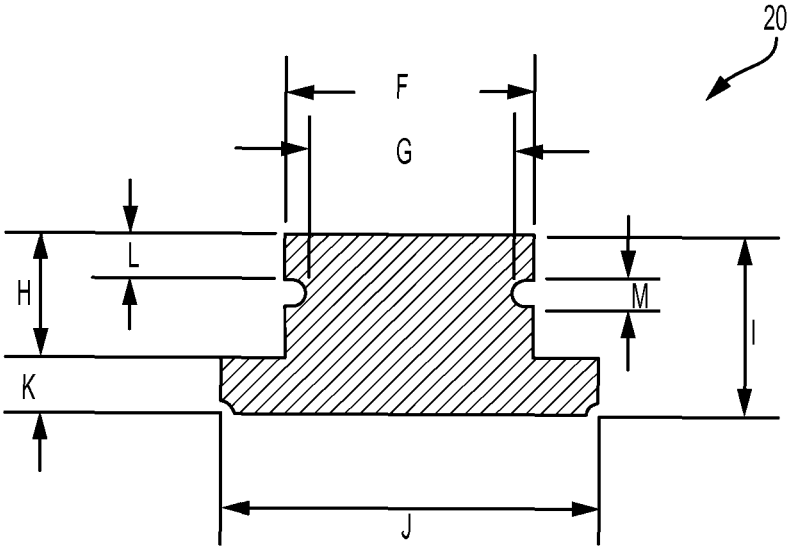
FIG. 7B is a cross-sectional view of the container cap taken through line B-B of FIG. 7A.

FIG. 7A is a bottom plan view of the cap 20 and FIG. 7B is a cross-sectional view of the cap 20 taken along the line B-B of FIG. 7A. As seen in FIG. 7B, the cap has an overall length I. In some embodiments, length I may range from 0.3 to 0.6 inches or from 0.4 inches to 0.5 inches. In one embodiment, length I is 0.468 inches. The plug 24 of the cap has a plug length H and a plug diameter F. In some embodiments, plug length H may range from 0.2 inches to 0.5 inches or from 0.3 inches to 0.35 inches. In one embodiment, the plug length H is 0.318 inches. In some embodiments, plug diameter F may range from 0.4 inches to 0.8 inches or 0.6 inches to 0.7 inches. In one embodiment, plug diameter F is 0.635 inches. The plug 24 has a minimum plug diameter G at the circumferential groove 26. In some embodiments, plug diameter G may range from 0.4 to 0.7 inches or 0.5 to 0.6 inches. In one embodiment, plug diameter G is 0.530 inches. The groove 26 is spaced from the plug end by a distance L and has a groove thickness M. In some embodiments, distance L may range from 0.02 inches to 0.2 inches or 0.07 inches to 0.15 inches. In one embodiment, distance L is 0.112 inches. The rim 22 of the cap has a rim diameter J and a rim thickness K. In some embodiments, diameter J may range from 0.2 to 2 inches or 0.7 to 1.3 inches. In one embodiment, diameter J is 0.965 inches. In some embodiments, rim thickness K may range from 0.02 to 0.3 inches or 0.1 to 0.2 inches. In one embodiment, rim thickness K is 0.15 inches.

Figure 8A:
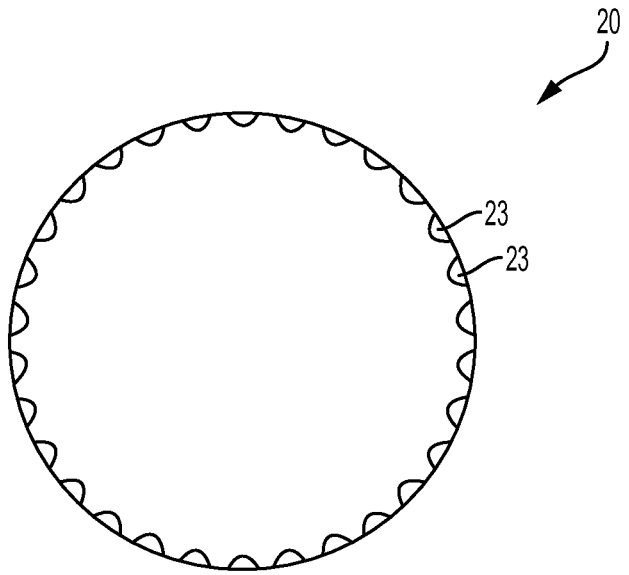
FIG. 8A is a top plan view of the container cap.
Figure 8B:
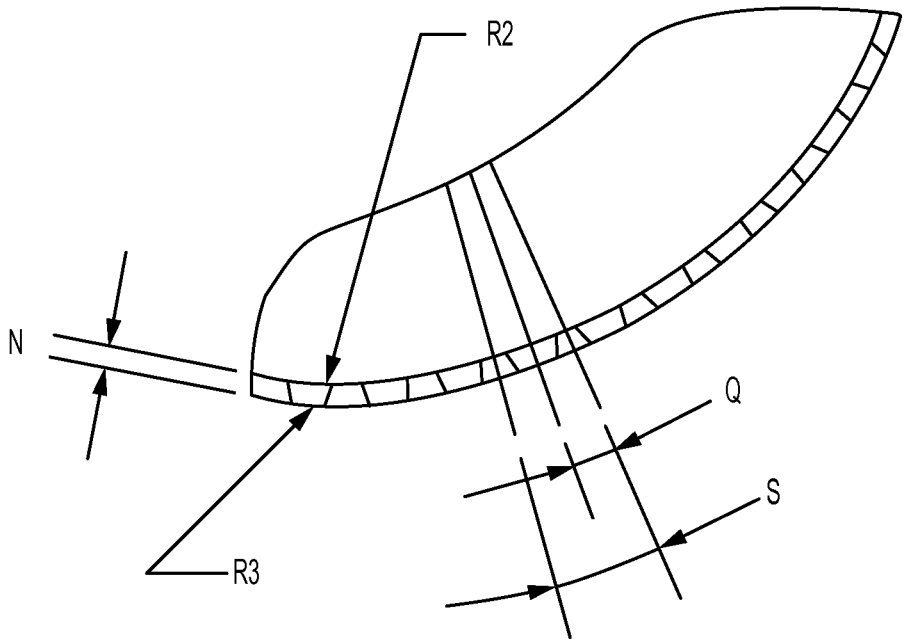
FIG. 8B is an enlargement of a portion of FIG. 8A.

As mentioned above, according to one aspect, the container is arranged to permit a user to manually remove the cap 20 from the container body 10 when desired. In some embodiments, the cap rim 22 includes features that aid in manual removal of the cap 20. As best seen in FIG. 4, the cap 20 includes a rim 22 having a diameter larger than that of the plug 24. The enlarged diameter of the rim provides leverage and may allow the user to have a better grip on the cap. To further aid in gripping the cap, the rim may include a textured surface. In one embodiment, best seen in FIGS. 4 and 8A, the rim includes a textured surface 23 comprising a series of indentations located along the circumference of the rim. Such a textured surface may allow a user to more easily grip the cap by hand or with a hand tool such as a pair of pliers. As shown in FIG. 8B, the indentations may be arranged in accordance with a specific geometry. The indentations are formed into the rim at a depth of N. In some embodiments, depth N may range from 0.01 to 0.05 inches or from 0.03 to 0.035 inches. In one embodiment, depth N is 0.032 inches. The indentations trace out an inner radius of curvature of R2, while the outer edge of the rim traces out an outer radius of curvature R3. In some embodiments, R2 ranges from 0.01 to 0.05 inches or from 0.03 to 0.035 inches. In one embodiment, R2 is 0.032 inches. In some embodiments, R3 may range from 0.02 to 0.06 inches or from 0.035 to 0.045 inches. In one embodiment, R3 is 0.04 inches. S represents the arc length between two adjacent indentations, while Q represents the arc length spanning from an indentation to an adjacent protrusion. In some embodiments, Q may range from 2.5 to 4.5 degrees or from 3 to 4 degrees. In one embodiment, Q is 3.73 degrees. In some embodiments, S may range from 6 to 9 degrees or from 7 to 8 degrees. In one embodiment, S is 7.5 degrees. The indentations shown in FIG. 8A are rounded. As seen in FIG. 4, the radius of curvature of each indentation is represented by R1. In some embodiments, R1 may range from about 0.01 to 0.05 inches or from 0.025 to 0.035 inches. In one embodiment, R1 is 0.03 inches. However, it should be appreciated that other textured surfaces may be used, such as small dimples, square, diagonal, or zig-zag indentations/protrusions. As seen in FIG. 4, the textured surface may span only a part of the rim. A portion of the rim having width P may remain untextured. In some embodiments, P may range between 0.03 to 0.06 inches or 0.04 to 0.05 inches. In one embodiment, P is 0.045 inches.

Figure 9B:
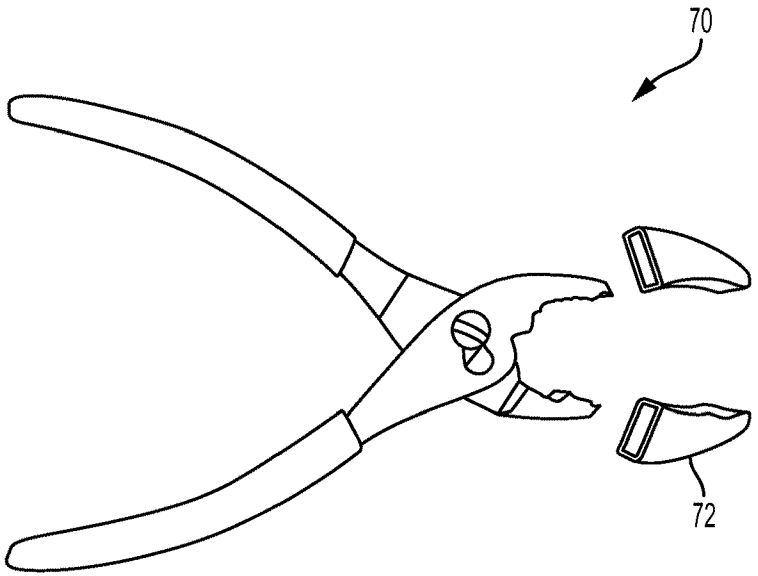
FIG. 9B is a front, perspective view of the pliers of FIG. 9A with the rubber grips detached from the pliers.
Figure 9A:
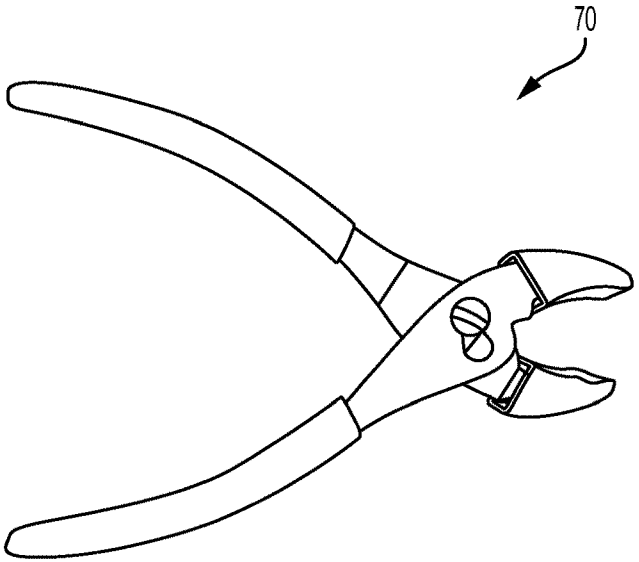
FIG. 9A is a front, perspective view depicting a pair of pliers with attached rubber grips in accordance with one aspect of the invention.

The user may manually remove the cap from the container by hand, or by using a hand tool. One example of such a hand tool is a pair of pliers 70, shown in FIGS. 9A-9B. In some cases, the user may couple rubber grips 72 to the pliers 70 to avoid or decrease the scraping of lead particles from the surface of the cap. Grips 72 typically conform to the shape and size of the indentations on textured surface 23 to provide an interlock between surface 23 and grips 72. The cap 20 can be removed by twisting the cap 20 in either direction relative to the container body 10 while pulling the cap 20 away from the container body. Typically, a quarter turn of the cap 20 is used to remove the cap and to seal the cap.

According to another aspect of the invention, the container 1 is arranged to attenuate radiation emitted by the radioactive fluid located within the container. In some embodiments, the container 10 is made of a material that substantially comprises a radiation shielding material. In one embodiment, the container body 10 and cap 20 are made predominantly of lead. The container body 10 and cap 20 may also contain other materials as well. In one embodiment, the container body 10 and cap 20 are made of about 96 to 97.3% lead and about 2.5 to 3.5% antimony, about 0.1 to 0.3% tin, about 0.1 to 0.2% arsenic and trace amounts of copper, bismuth, silver, nickel and sulfur. In other embodiments, the container body 10 and cap 20 may be made of other radiation shielding materials such as actinium, antimony, barium, bismuth, bromine, cadmium, cerium, cesium, gold, iodine, indium, iridium, lanthanum, lead, mercury, molybdenum, osmium, platinum, polonium, rhenium, rhodium, silver, strontium, tantalum, tellurium, thallium, thorium, tin, tungsten, uranium or zirconium.

The process for manufacturing the container will now be discussed. In one embodiment, the container body 10 and the cap 20 are formed using a casting process. In other embodiments, the container body 10 and cap 20 may be formed using extrusion, forging, machining, or any other suitable process. The cap 20 is formed with a plug 24 preferably having a circumferential groove 26. The groove 26 may be formed simultaneously with the formation of the cap 20 (e.g., the mold used to create the cap includes a protruding ring geometry that forms the groove), or the groove 26 may be later milled or etched or otherwise formed after the cap 20 has been formed. The O-ring 30 is coupled to the cap by expanding the O-ring 30 to a diameter greater than that of plug 24 and placing the O-ring around plug 24 and preferably in groove 26.

Figure 10:
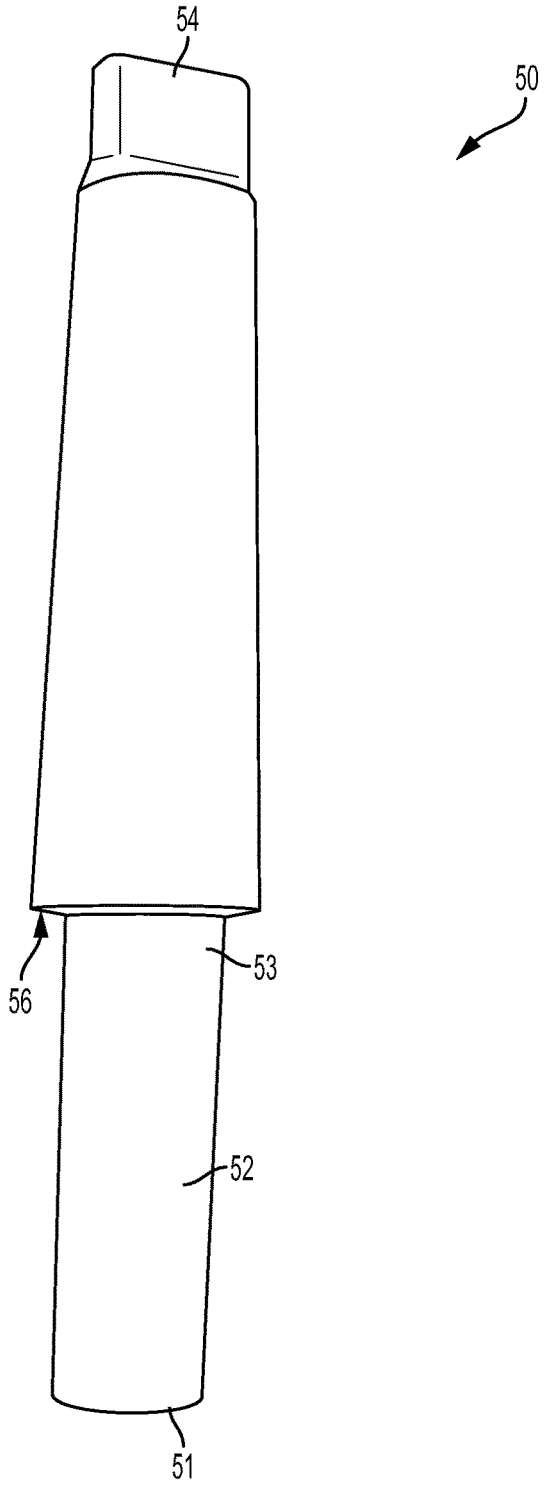
FIG. 10 is a front, perspective view depicting a burnishing tool in accordance with one aspect of the invention.

In some embodiments, portion 16 of inner wall 14 is burnished using a specialized burnishing tool 50. In one embodiment, as shown in FIG. 10, tool 50 has a burnishing portion 52 that is inserted into the chamber 11 and a coupling portion 54 that is used to couple the burnishing tool 50 to a machine that rotates the burnishing tool at a high rate of speed about its longitudinal axis. Burnishing portion 52 has a leading end 51 and a trailing end 53. In some embodiments, the burnishing portion 52 is tapered such that the diameter of the burnishing portion increases from the leading end 51 to the trailing end 53. As such, the leading end 51 has a smaller diameter than the trailing end 53. The tapered burnishing portion 52 can be used to create a tapered portion 16 of wall 14 (i.e., such that the inside diameter of the chamber 11 increases in a direction toward the chamber opening 12 along at least a portion of wall 14. As seen in FIG. 10, the burnishing tool 50 may have an abutment 56 adjacent to the trailing end 53 of the burnishing portion 52. The abutment 56 may be a step, i.e., a sudden increase in diameter relative to the diameter of the trailing end 53. In some embodiments, the abutment 56 may serve as a stop that controls the depth of insertion of burnishing portion 52 into the container chamber. That is, when the burnishing portion 52 is inserted into the container chamber 11, the abutment 56, due to its large diameter, may abut against the opening rim of the chamber 11, preventing the burnishing tool from being further inserted into the chamber 11. As such, abutment 56 limits the maximum depth of insertion of the burnishing portion 5 into the chamber 11, which then sets the depth of portion 16.

Figure 11:
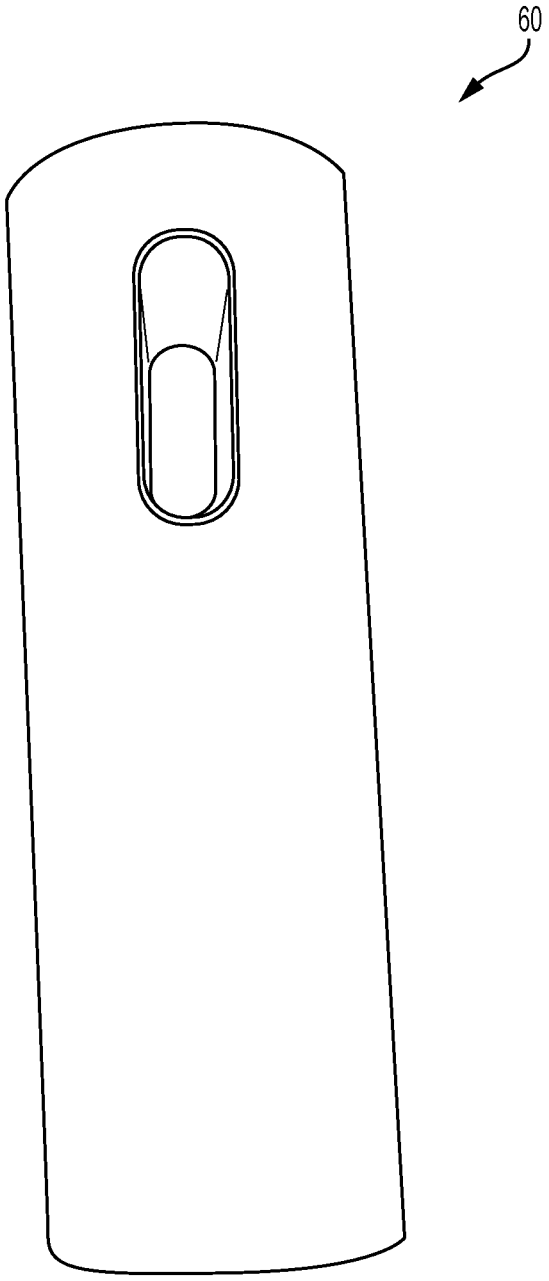
FIG. 11 is a front, perspective view depicting a holder used with the burnishing tool of FIG. 10.

The burnishing tool 50 may be held within a holder 60 shown in FIG. 11, and the holder 60 may be coupled to a machine that rotates the holder 60 and the burnishing tool 50 at a high speed, such as a drill, a lathe or lathe-like machine, or the like. In some cases, the coupling portion 54 couples the burnishing tool 50 to the holder 60. In other cases, the coupling portion 54 may be directly coupled to the machine. In one embodiment, the burnishing tool is made of S7 tool steel.

With the O-ring 30 coupled to the plug 24, the plug 24 is inserted into the opening 12 of the chamber 11 until the plug 24 is fully received within the chamber opening 12 and the O-ring 30 is seated against the burnished portion 16 of the inner wall 14 of the chamber to form a fluid tight seal, and is particularly suited to form gas tight seal. In some cases, the cap 20 is rotated relative to the container body 10 while inserting the plug 24 into the chamber opening 12. Such a motion may help to avoid rolling, twisting, kinking, unseating or otherwise negative behavior of the O-ring 30 during capping of the container 1. In one embodiment, the cap 20 is twisted one quarter-turn relative to the container body 10 while the cap plug 24 is inserted. Capping of the containers may be accomplished by hand, with a hand tool, or with an automatic capping machine.

Also, as described herein, the container 1 may be used for containing and shielding other radioactive substances, including other gaseous materials, liquids or solids.

Having thus described several aspects of at least one embodiment of this invention, it is to be appreciated that various alterations, modifications, and improvements will readily occur to those skilled in the art. Such alterations, modification, and improvements are intended to be part of this disclosure, and are intended to be within the spirit and scope of the invention. Accordingly, the foregoing description and drawings are by way of example only.

What is claimed is:

1. A container for a radioactive fluid, the container comprising:

a body having a hollow inner chamber for containing the radioactive fluid, the chamber including an inner surface and an opening, a portion of the inner surface having a smooth burnished surface;

a cap removably couplable to the body for sealing the opening, the cap having a plug that is insertable into the chamber through the opening, wherein the plug includes a groove; and an O-ring disposed within the groove of the plug, wherein an outer edge of the O-ring seats against the smooth burnished surface when the plug is fully received within the opening of the chamber, and wherein the body and the cap are made of a material substantially comprising a radiation shielding material.

2. The container of claim 1, wherein the burnished surface comprises a tapered burnished surface.

3. The container of claim 1, wherein with the plug fully received within the opening of the chamber, the cap is manually removable from the body.

4. The container of claim 1, wherein with the plug fully received within the opening of the chamber, the cap remains coupled to the body when pressure inside the chamber is higher than pressure outside the container by 7-15 psi.

5. The container of claim 1, wherein the O-ring comprises a silicone rubber.

6. The container of claim 1, wherein the radiation shielding material includes lead.

7. The container of claim 6, wherein the radiation shielding material substantially comprises lead and antimony.

8. The container of claim 1, wherein with the plug fully received within the opening of the chamber, the cap remains coupled to the body when the container is subjected to a temperature in the range of −40° C. to 70° C.

9. The container of claim 1, wherein the cap includes a manually gripable outer rim.

10. The container of claim 1, wherein the groove comprises a circumferential groove.

11. The container of claim 1, wherein the radioactive fluid comprises a radioactive gas.

12. A method of manufacturing a container for a radioactive fluid, the method comprising:

forming a body having a hollow inner chamber for containing the radioactive fluid, the chamber including an inner surface and an opening;

burnishing at least a portion of the inner surface of the chamber to form a burnished portion of the inner surface;

forming a cap that is removably coupleable to the body for sealing the opening, the cap having a plug that is insertable into the chamber through the opening, wherein the plug includes a groove;

coupling an O-ring to the cap by inserting the O-ring into the groove on the plug; and inserting the plug into the opening of the chamber until the plug is fully received within the opening and the O-ring is seated against the burnished portion of the inner surface of the chamber to form a fluid tight seal, wherein the body and the cap are made of a material substantially comprising a radiation shielding material.

13. The method of claim 12, wherein the step of forming the body comprises casting the body.

14. The method of claim 12, wherein the step of forming the cap comprises casting the cap.

15. The method of claim 12, wherein the step of burnishing comprises:

inserting a burnishing tool into the chamber through the opening such that at least a portion of the burnishing tool contacts the inner surface of the chamber; and rotating the burnishing tool relative to the body.

16. The method of claim 15, wherein the burnishing tool comprises a tapered outer surface.

17. The method of claim 15, wherein the burnishing tool comprises S7 tool steel.

18. The method of claim 12, wherein the radiation shielding material includes lead.

19. The method of claim 18, wherein the radiation shielding material substantially comprises lead and antimony.

20. The method of claim 12, wherein with the plug fully sealed with the burnished surface, the cap remains coupled to the body when pressure inside the container is higher than pressure outside the container by 7-15 psi.

21. The method of claim 12, wherein the groove comprises a circumferential groove.

22. The method of claim 12, wherein the radioactive fluid comprises a radioactive gas.

23. The method of claim 12, wherein the burnished portion comprises a tapered burnished portion.

* * * * *